US006336578B1

(12) United States Patent
Maynard

(10) Patent No.: US 6,336,578 B1
(45) Date of Patent: Jan. 8, 2002

(54) WEARABLE CORD HOLDER

(76) Inventor: Bobby D. Maynard, 413 C.R. 304, Bertram, TX (US) 78605

( * ) Notice: Subject to any disclaimer, the term of this patent is extended or adjusted under 35 U.S.C. 154(b) by 0 days.

(21) Appl. No.: 09/545,986

(22) Filed: Apr. 10, 2000

Related U.S. Application Data

(60) Provisional application No. 60/139,613, filed on Jun. 17, 1999.

(51) Int. Cl.[7] ..... A45F 5/00

(52) U.S. Cl. ..... 224/248; 224/268; 224/904

(58) Field of Search ..... 224/248, 268, 224/602, 604, 242, 904; 24/3.1, 3.11, 3.12

(56) References Cited

U.S. PATENT DOCUMENTS

| | | | | |
|---|---|---|---|---|
| 1,396,499 A | | 11/1921 | Bell | |
| 2,320,067 A | | 5/1943 | Caughren | |
| 2,551,019 A | | 5/1951 | Pierre | |
| 3,104,434 A | | 9/1963 | Noordhoek | |
| 3,155,298 A | | 11/1964 | Brown | |
| 3,279,009 A | | 10/1966 | Deane | |
| 3,285,482 A | * | 11/1966 | Bedsaul, Sr. | 224/248 |
| 3,809,349 A | * | 5/1974 | Baedke | 2/3.12 |
| 4,638,530 A | | 1/1987 | Perry | |
| 5,176,302 A | | 1/1993 | Smith | |
| 5,571,228 A | * | 11/1996 | McMurtrie | 224/268 X |
| 5,758,809 A | | 6/1998 | Bonner | |
| 5,829,103 A | * | 11/1998 | Allen | 24/3.11 |

* cited by examiner

*Primary Examiner*—Gregory M. Vidovich
*Assistant Examiner*—Maerena W. Brevard
(74) *Attorney, Agent, or Firm*—Baker Botts L.L.P.

(57) ABSTRACT

A cord holder for use with hand-held equipment that requires a power cord, air hose, or the like. The cord holder has a clip that attaches over a pocket or belt or similar item of apparel. A loop and hook securely hold a bight of the cord. The cord in front of the cord holder goes to the equipment, and has a desired amount of slack as selected by the user. Because of the secure attachment of the cord within the cord holder, the cord behind the cord holder may be pulled as the user moves about, without affecting the slack in the cord in front of the cord holder.

15 Claims, 2 Drawing Sheets

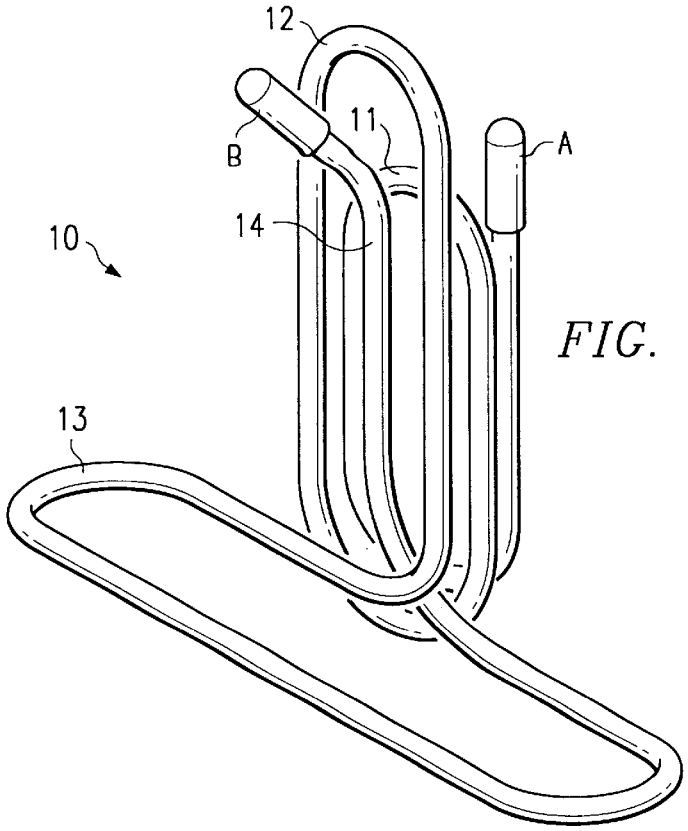
FIG. 1
FIG. 2
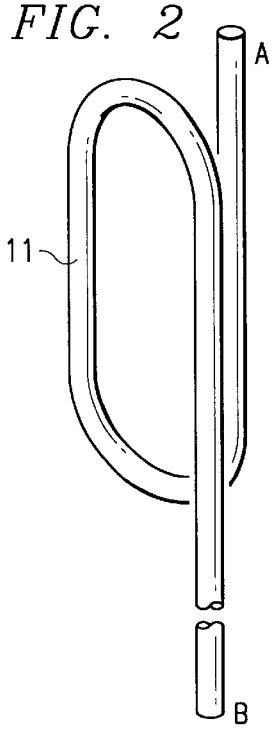
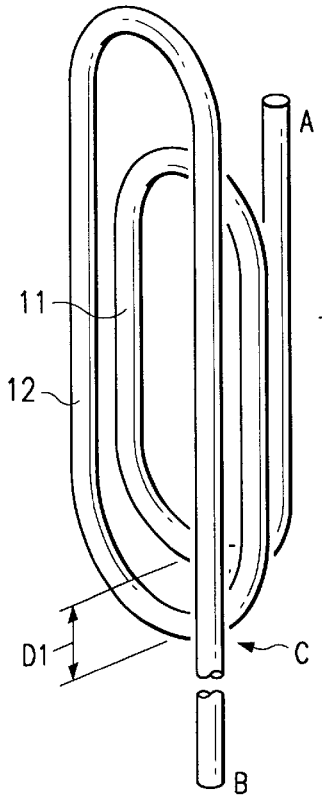
FIG. 3

WEARABLE CORD HOLDER

RELATED PATENT APPLICATION

This application claims the benefit of U.S. Provisional Application No. 60/139,613, filed Jun. 17, 1999 and entitled "Wearable Cord Holder".

TECHNICAL FIELD OF THE INVENTION

This invention relates to clips and holders worn on the body, and more particularly to a cord holder that attaches to clothing and holds a tool cord such that its lengths in front of and behind the holder can be easily selected and maintained constant after being selected.

BACKGROUND OF THE INVENTION

Various patents have taught the use of cord clips to be attached to clothing of the user. For example, U.S. Pat. No. 3,155,298, to Brown, describes a clip especially designed for electrical hair clippers. The clip is attached to a front pocket of a barber smock. The cord rests in a "saddle" formed by the clip. U.S. Pat. No. 5,758,809, to Bonner, describes a cord holding harness. The cord is slung over the user's shoulder and attaches to a clip at the user's back.

SUMMARY OF THE INVENTION

One aspect of the invention is a cord holder that attaches to an article of clothing and holds a cord for hand-held equipment. The cord holder has two vertical loops, one horizontal loop, and a hook. The first vertical loop is inserted inside a portion of apparel, such as a belt or pocket, worn by the user. This first loop is generally flat so that it may rest against the user's body when so inserted. The second vertical loop is in a plane adjacent the plane of the first loop, and attaches outside the portion of apparel. The two vertical loops each have a top edge and a bottom edge, such that the first loop and the second loop may form a clip over the portion of apparel by pushing the bottom edges of the loops over opposing sides of the portion of apparel. The horizontal loop is attached to and extends outwardly from the second loop in a plane perpendicular to the first and second loops. The hook first extends upwardly from the horizontal loop in substantially the same plane as the second loop, and then extends outwardly from the second loop. After the cord holder is attached to the user, the user grabs a bight of cord and pushes or pulls it into the horizontal loop and over the hook.

BRIEF DESCRIPTION OF THE DRAWINGS

FIG. 1 illustrates a cord holder in accordance with the invention.

FIGS. 2–4 illustrate the process of making the cord holder of FIG. 1.

DETAILED DESCRIPTION OF THE INVENTION

Figure 5:
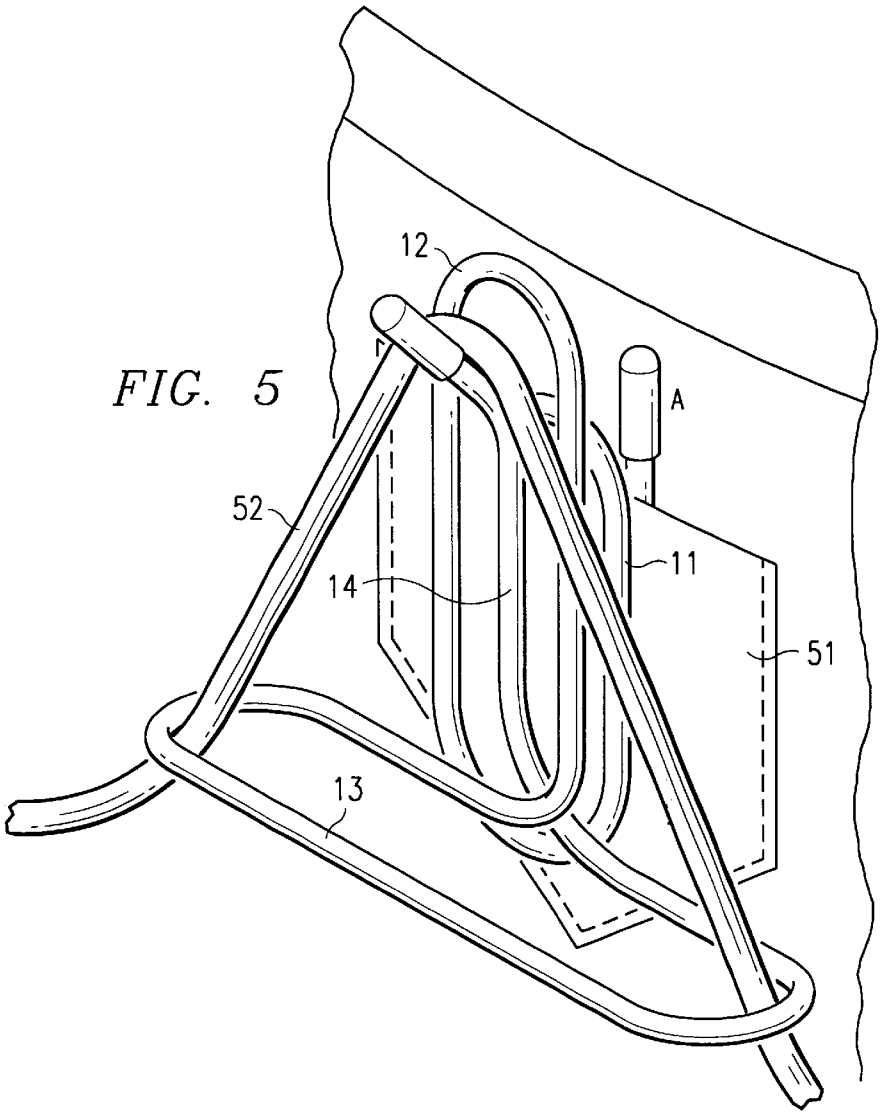
FIG. 5 illustrates the cord holder in use, attached to a back pocket of the user's pants.

FIG. 1 illustrates a cord holder 10 in accordance with the invention. Although the dimensions of cord holder 10 may vary depending on the type of equipment with which it is used, for a typical application, cord holder 10 is approximately 4 inches high, six inches wide, and 2 inches deep.

A feature of the invention is that cord holder 10 is constructed from a single piece of rod-like material. In the example of this description, the material is a solid metal rod having a round cross section. Other materials could be used, such as plastic. The material could be tubular rather than solid. The cross section could be rectangular or oval. However, regardless of the type of material, a common characteristic is that it that it may be formed in the shape illustrated and after being thus formed, remains substantially rigid.

Cord holder 10 has several basic parts, identified as a back vertical loop 11, a front vertical loop 12, a horizontal loop 13, and a hook 14. During manufacture, cord holder 10 may be formed by shaping a rod to form these parts in the order listed. In FIG. 1, the ends of the rod are identified as A and B. Depending on the type of material used to construct cord holder 10, protective caps may be placed at these ends.

In the example of this description, the "shaping" is accomplished with known metal working techniques. Other techniques, such as molding, could be used.

Figure 4:
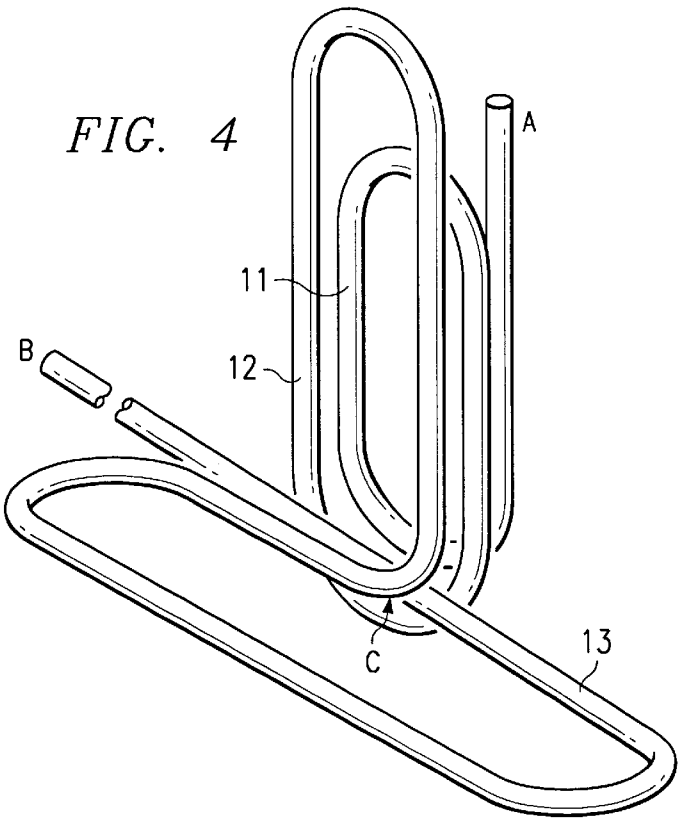

FIGS. 2–4 illustrate how cord holder 10 may be formed from a single rod beginning at end A. The process could be reversed, so that the manufacture begins at end B. The one-piece construction of FIGS. 2–4 is not necessary to the invention; remarks set out below in connection with the structure of cord holder 10 are relevant if cord holder 10 is made from more than one piece of material.

As illustrated in FIG. 2, the back vertical loop 11 is formed by bending the rod in a closed loop, leaving end A pointing upwardly and generally meeting at end A. In the example of FIG. 2, the loop is generally a rectangle with rounded ends, but other closed shapes could be used. The "loop" could even be triangular.

FIG. 3 illustrates how front vertical loop 12 is next formed by extending the free end of the rod downwardly to from the area of end A to point C, then making a complete loop back to point C. As is the case with loop 11, loop 12 could have a variety of closed shapes. The bottom portions of loops 11 and 12 are slightly offset by a distance, D1. As explained below, during use of cord holder 10, the bottom edges of loops 11 and 12 are pushed over opposing sides of a pocket or belt. In the example of FIG. 3, loop 12 extends slightly below loop 11, but this relationship could be reversed.

Loops 11 and 12 are closely placed against each other in adjacent vertical planes. As explained below in connection with FIG. 5, they form a structure analogous to a "paper clip", permitting cord holder 10 to be attached to a pocket, belt, or other apparel. Their flat structure permits them to rest against the user's body when the cord holder 10 is attached.

As illustrated in FIG. 4, horizontal loop 13 is formed by bending the rod to form a loop in a plane perpendicular to that of loops 11 and 12. Loop 13 begins and ends generally at point C, and extends outwardly from loop 12. In FIG. 4, loop 13 extends outwardly from the bottom edge of loop 12, but in other embodiments, loop 13 could be raised slightly with respect to loops 11 and 12.

Referring again to FIG. 1, hook 14 is next formed by bringing the free end of the rod upward and then outward. In the example of this description, hook 14 is formed "inside" loop 12 by bringing the rod behind point C, but it could also be formed by bringing the rod in front of point C. An advantage of the method shown is that hook 14 is closely spaced against loop 11, which, as explained below, ensures a secure point of attachment for a cord during use. The vertical portion of hook 14 ends generally in the same area as the top half of loop 12.

For the 4×6×2 cord holder dimensions described above, a typical width of loops 11 and 12 might be 1½ inches.

Distance D1 might be ¼ to ½ inch. Loop 13 might be 2 inches wide, and hook 14 might extend outwardly a distance of 1 inch. Loop 11 is illustrated as being slightly smaller than loop 12, but this relationship could be reversed, and their sizes may be more different to some extent.

FIG. 5 illustrates cord holder 10 attached to a user's back pants pocket 51. In the example of FIG. 5, cord holder 10 is used to hold an electrical power cord 52 for a power tool. However, the uses of cord holder 10 are varied—it may be also be used to hold air hoses for air tools, as well as other types of cords, tubes, or lines for other hand-held equipment. In general, cord 52 may be thought to have a "slack" end that goes from cord holder 10 to the hand-held equipment, and a "pull" end that goes from cord holder 10 to a power source, such as an electrical outlet or air compressor.

Loop 11 is inside the pocket, whereas loop 12 is outside. Close spacing of loop 11 against loop 12 ensures a snug fit. Ideally, cord holder 10 is made from a material sufficiently flexible to permit loops 11 and 12 to separate slightly to fit over pocket 51. The same is true if cord holder 10 is used on a belt, harness, or other apparel. In general, cord holder 10 may be attached to any article of clothing, which has a thin flat strap or flap worn against the user's body, the strap or flap having a lip or edge over which the clip formed by loops 11 and 12 may be pushed. Ideally, the article of apparel to which cord holder 10 is attached fits snugly to the body, so that, as explained below, movement of the user's body easily translates to pull-along motion of the pull end of cord 52. Regardless of the type of apparel, loop 11 is "inside" relative to loop 12, that is, loop 11 is against the user's body.

The back of horizontal loop 13 and of hook 14 both rest against the user's body. Thus, loop 13 and hook 15 extend outwardly from the user's body.

In operation, the user may easily grab cord 52 and form a small bight. The user then pushes this bight up into loop 13 and over hook 14. The cord is now secured behind hook 14 against the users body. The bight of cord 52 is inside horizontal loop 13. Each end of loop 13 acts as a "stop" for the cord 52 as the user operates the tool, taking at least some tension off hook 14 if cord 52 is pulled in either direction. Thus, the bight of cord 52 is secured in cord holder 10 by both hook 14 and loop 13.

With regard to the "slack" end of cord 52, the user may easily select the section of cord 52 that is to form the bight to be brought into cord holder 10. In this manner, the user selects a desired length of cord 52 between cord holder 10 and the equipment. This selected length has a desired amount of slack. During use of the equipment, cord holder 10 maintains this length between cord holder 10 and the tool. This ensures that the user has sufficient length to freely use the tool but that there is not too much excess cord so as to interfere with use. Once cord 52 is attached to cord holder 10, the "pull" end of cord 52 remains behind the user, out of the way of the equipment. Because of the secure attachment of the cord 52 within cord holder 10, the length of the source end is maintained constant. As the user operates the equipment and moves from place to place, cord holder 10 permits the user to pull the cord along, without creating tension on the equipment. Cord holder 10 is especially useful for construction equipment where the use must handle heavy equipment and must have a fairly large range of travel. The user's lower body does the work of pulling the cord, rather than the user's arms and hands.

Attachment of the cord within cord holder 10 is as simple as grabbing a bight of cord, and pulling or pushing it into loop 13 and over hook 14. The cord may be easily detached or adjusted.

OTHER EMBODIMENTS

Although the present invention has been described in detail, it should be understood that various changes, substitutions, and alterations can be made hereto without departing from the spirit and scope of the invention as defined by the appended claims.

What is claimed is:

1. A cord holder for attachment to an article of clothing for holding a cord for hand-held equipment, comprising:

a clip for insertion over a flat and thin portion of apparel worn by the user, the clip being generally flat such that it rests against the user's body when so inserted;

a horizontal loop attached to and extending outwardly from the clip in a plane perpendicular to the clip;

a hook, first extending upwardly from the horizontal loop in substantially the same plane as the clip, ad then extending outward from the clip; and wherein the clip and the horizontal loop are made from a continuous piece of material.

2. The cord holder of claim 1, wherein the hook is further made from the same continuous piece of material.

3. The cord holder of claim 1, wherein the clip is comprised of a first and second loop in adjacent plane.

4. The cord holder of claim 1, wherein the horizontal loop extends from the bottom edge of the clip.

5. The cord holder of claim 1, wherein the hook extends upwardly so as to intersect the same plane as the clip.

6. A cord holder for attachment to an article of clothing, for holding a cord for hand-held equipment, comprising:

a first loop for insertion inside a portion of apparel worn by the user, the first loop being generally flat such that it rests against the user's body when so inserted;

a second loop in a plane adjacent the plane of the first loop, for attachment outside the portion of apparel;

wherein the first loop and the second loop each have a top edge and a bottom edge, such that the first loop and the second loop may form a clip over the portion of apparel by pushing the bottom edges of the loops over opposing sides of the portion of apparel;

a third loop attached to and extending outwardly from the second loop in a plane perpendicular to the first and second loops; and a hook, first extending upwardly from the third loop in substantially the same plane as the second loop, and then extending o from the second loop.

7. The cord holder of claim 6, wherein the first, second, and third loops are made from a continuous piece of material.

8. The cord holder of claim 7, wherein the hook is further made from the same continuous piece of material.

9. The cord holder of claim 6, wherein the bottom edges of the first and second loop are slightly offset from each other.

10. The cord holder of claim 6, wherein the third loop extends from the bottom edge of the second loop.

11. The cord holder of claim 6, wherein the hook extends upwardly so as to intersect the same plan as the second loop.

12. The cord holder of claim 6, wherein the first and second loops are substantially the same size.

13. The cord holder of claim 6, wherein the first and second loops have a point of attachment sufficiently elastic so as to permit them to be slightly separated.

14. The cord holder of claim 6, wherein the first and second loops are generally rectangular in shape with rounded ends.

15. The cord holder of claim 6, wherein the third loop is generally rectangular in shape with rounded ends.

* * * * *